US005702338A

United States Patent [19]

Morando

[11] Patent Number: 5,702,338

[45] Date of Patent: *Dec. 30, 1997

[54] HEAT TREATING, ANNEALING AND TUNNEL FURNACE ROLLS

[76] Inventor: Jorge A. Morando, 34210 James J. Pompo Dr., Fraser, Mich. 48026

[ * ] Notice: The term of this patent shall not extend beyond the expiration date of Pat. No. 5,338,280.

[21] Appl. No.: 540,880

[22] Filed: Oct. 11, 1995

Related U.S. Application Data

[63] Continuation of Ser. No. 287,647, Aug. 9, 1994, abandoned, which is a continuation-in-part of Ser. No. 36,328, Mar. 24, 1993, Pat. No. 5,338,280.

[51] Int. Cl.[6] ..... B23P 15/00

[52] U.S. Cl. ..... 492/30

[58] Field of Search ..... 492/30–36, 38, 492/39; 29/895.32

[56] References Cited

U.S. PATENT DOCUMENTS

| | | | |
|---|---|---|---|
| 1,997,469 | 4/1935 | Ornitz . | |
| 2,757,445 | 8/1956 | Anger . | |
| 3,997,370 | 12/1976 | Horvath, Jr. . | |
| 4,144,022 | 3/1979 | Fusco . | |
| 4,470,802 | 9/1984 | Zaizen . | |
| 5,044,056 | 9/1991 | Sundstedt . | |
| 5,070,587 | 12/1991 | Nakahira . | |
| 5,161,306 | 11/1992 | Nakahira et al. | 29/895.32 |
| 5,230,618 | 7/1993 | Bricmont et al. | 432/236 |
| 5,338,280 | 8/1994 | Morando | 492/36 |

*Primary Examiner*—Irene Cuda

*Attorney, Agent, or Firm*—Charles W. Chandler

[57] ABSTRACT

A furnace roll for transferring steel strips from an annealing furnace has several spaced rings along the body of the roll. The rings have a width and diameter chosen such that the load on each ring is optimized depending upon the material of the strip and the ring material. The selected ring material is relatively insoluble with the strip material.

20 Claims, 6 Drawing Sheets

PENETRATION HARDNESS CURVE

HEAT TREATING, ANNEALING AND TUNNEL FURNACE ROLLS

CROSS REFERENCE TO RELATED APPLICATION

This is a continuation of application Ser. No. 08/287,647, filed Aug. 9, 1994, now abandoned, which is a continuation in part of application Ser. No. 08/036,328, filed Mar. 24, 1993, now U.S. Pat. No. 5,338,280.

BACKGROUND OF THE INVENTION

Rolls used in annealing and heat treating furnaces, even when properly designed from the stress point of view, fail due to ADHESION. Adhesion is the primary cause of failure and requires continuous maintenance of the roll surface by weekly "dragging", and bi-monthly machining the roll's surface.

Dragging the furnace consists of sliding a plate having a chain mesh, over the furnace rolls at a high temperature (1900° F. to 2000° F.) in the opposite direction of the rotation of the rolls (reverse direction of the usual operation of the furnace). This process eliminates the weekly build-up that has accumulated on the rolls. After several weeks (usually monthly), the rolls are removed and the surfaces are ground. Unfortunately, these methods are insufficient to minimize the most expensive of all the consequences: poor strip quality. The rejection rates are staggering.

The effect caused by roll adhesion in annealing furnaces, where the temperature of the strip is above 2000° F. (and the strip hardness is lower than that of the roll) is that the roll "picks up" from the strip. The accumulated build-up punctures the strip surface, producing a strip of reduced or unacceptable quality, because of poor surface finish. On the other hand, in heat treating furnaces where the temperature is below 1700° F. and, in general, the hardness of the roll surface is comparable to the hardness of the strip, the strip "picks up" from the roll producing pits, imperfections and wear of the roll. By carrying the roll particles, the strip creates a strip surface of an unacceptable quality.

Adhesion is the phenomenon which occurs when two surfaces come in contact under a pure normal load. However, at high temperatures, especially near the melting point of the materials in contact, no load is required to create adhesion because of the extremely high energy of adhesion available. (Reference: Rabinowicz, FRICTION AND WEAR OF MATERIALS, 1965)

The normal tension force that must be exerted to separate the surfaces is considered the adhesion force. Evidence of the strong tendencies of solids to adhere is found in the process of adhesive wear. This phenomenon must be addressed, since it is and has been for years the reason for the failure of annealing and heat treating furnace rolls.

Adhesive wear exists whenever one solid metallic material contacts the surface of another. The removal of material takes the form of small particles that are usually transferred from one surface to the other surface, or that may come off in loose form. Both cases occur in annealing and heat treating furnace rolls.

The wear mechanism is the consequence of the tendency of contacting surfaces to adhere, due to the attracting forces existing between the surface atoms of the two materials in contact. If two surfaces are brought together and then separated, these attractive forces attempt to pull material from one surface onto the other. This is much more severe when the two materials in contact are soluble into each other, and/or the contact takes place at high temperatures or near the melting point of one or both of the materials in contact, as in annealing furnace rolls and heat treating furnace rolls. Whenever material is removed from its original surface in this way, an adhesive wear fragment is created.

CONTACT AREA MINIMIZATION RATIONALE

When two solid metallic material surfaces are placed very close together, some areas will be in intimate contact and others will be farther apart. It is important to know which atoms interact strongly with the corresponding atoms of the surface and which do not. FIG. 1 is a schematic illustration of an interface, showing the apparent and real areas of contact. This interaction is important when the operating temperature is near the melting point of the two materials. It is known that atom-to-atom forces are of a very short range (a few angstroms).

To simplify the problem, assume that all the interaction between the two surfaces occurs only where there is atom-to-atom contact. These regions of contact in the adhesion theory are referred to as junctions. The sum of the areas of all the junctions constitute the "real area of contact, $A_R$". The total interfacial area consists of both the real area of contact, $A_R$, and those regions which appear in contact, but where the distance between the surfaces assure us that it is not, and will be referred to as the "apparent area of contact, $A_\alpha$".

Although the regions within the apparent area of contact may be far larger than the real area of contact, they play no part in determining the overall interaction of the two surfaces. Very weak long-range forces exist at points separated by distances exceeding 10 angstroms (10 A). Abrikosova and Deryagin (1957) have shown that because of the very small size of these forces, they are negligible in magnitude compared with the short range forces. FIG. 2 shows these forces exerted over a single junction. Note the resemblance to FIG. 6.

$A_R$ can be calculated assuming ideal plastic deformation. To calculate the value for $A_R$, note that a typical junction of the surfaces in contact will appear as in FIG. 2. This shows that the interface is in a state of triaxial constraint. The largest compressive stress that such a region of material can carry without plastic yielding is known as its penetration hardness, "P". The penetration hardness, P, has been shown to be three to five times the compressive yield strength of the metallic material (see FIG. 3). This has also been shown to be true for metallic alloys and many non-metals (see FIG. 3). This demonstration has been made both theoretically and experimentally by Tabor (1951). Consequently, we can write that the real area of contact, $A_R$ is greater or equal to L/P.

FIG. 3 compares the yield stress and hardness for elemental metals.

Based on the preceding discussion, we realize the importance of establishing the minimum area of contact that will be able to carry the load, in our case, the steel strip being conveyed in the furnace. FIG. 4, shows adhesion forces created when two identical metallic materials come in contact under a constant load. When the area of contact is gradually increased, the adhesion forces diminish up to a point, past which the adhesion forces begin to increase again in opposition to the theoretical stand that as the surface unit load (L/A) is decreased, the adhesion forces should continue to decrease.

By increasing the apparent area of contact beyond the minimum area needed for carrying the load under consideration, the junctions that generate adhesion and the consequent wear and damage is increased unnecessarily (the real area of contact is increased). Consequently, the total adhesion forces increase despite the fact that the specific load per unit area has decreased (see FIG. 4)—this emphasis on minimization of contact area being the strongest supporter of my invention.

FIG. 4 also shows that by changing one of the two materials in contact for a different material, we can decrease the adhesion forces that were being created. But, the minimum area of contact remains the same since it is a function of the weaker of the two materials (the strip in our application).

MATERIAL SELECTION AND FORMULATION

Adhesive wear cannot be explained unless strong adhesive forces exist between the contacting solids. Yet, adhesive wear occurs universally. Also, in Rabinowicz, page 28, we see the importance of surface energy as a reductor of adhesion, showing the close correlation of surface energy versus hardness.

Adhesion by pure normal contact is generally small. The foremost reason is the very small value of the real area of contact that is even further reduced when the normal load is removed. When the contact between the metallic materials takes place at very high temperatures, the adhesion forces could be substantial (unless the proper mating material is selected and the area minimized), and the consequence of the adhesive wear is the damage characteristically found on furnace rolls. It is difficult to identify the most important parameters that increase or decrease adhesion. It is clear, however, that adhesion is high when:

a. Materials have high surface energy, since this will make it more difficult for a junction to be broken.

b. Adhesion will be high if the material selected in contact can store small amounts of elastic energy, since this will reduce the elastic spring-back.

c. It is significant that adhesion is far more pronounced with unlike metal pairs which form intermediate phases than with metal pairs which are insoluble. The reason is that insoluble metal pairs have smaller energy of adhesion values. (Keller, 1963)

SUMMARY OF THE INVENTION

The broad purpose of the present invention is to provide a roll for an annealing furnace having a substantially greater fatigue life. In actual practice, since the strip material being processed cannot be changed (it is dictated by the customer), I have formulated the materials in contact with the steel strip (I call them wear rings) to contain large concentrated amounts of chromium carbide, tungsten carbide, vanadium carbide and the like on their surfaces, obtaining in this fashion a wear ring surface with a very high hardness, and simultaneously, a low surface energy that will minimize and in some instances eliminate adhesion. FIG. 5 is a plot of surface energy at the melting point against hardness at room temperature, for some metals and non-metals. In addition, this surface has an enormous resistance to micro-welding because of the high carbon content in the elements forming it, nearly eliminating their solubility with the strip material.

Any micro-weld that could take place between the roll wear ring and the steel strip surfaces must prevent the formation of alloys with metallic bonding properties (tough, flexible and strong). If alloy welds occur, they should have the characteristics of a covalent bonded alloy (weak, brittle and friable) such that upon subsequent rotation of the roll, the plane of separation will be at the formed weld, not inside the strip or the roll wear rings, since these are the types of breakage that generate roll pitting or build-up. In other words, if the wear ring material is not properly formulated at the real area of contact between the wear ring and the strip, a high adhesion force or a micro-weld will take place. When this contact is broken, the break will occur along the latter surface producing a transferred wear particle.

Experiments on adhesive wear carried out with metals that were soluble into each other (thus creating micro-welding) indicated the importance of the selection of the materials in contact and pointed to the fact used in my invention: when operating at high temperature, the inter-diffusion and re-crystallization of material near the original interface of the surface atoms of the two metals has to be eliminated if the wear and failure of annealing and heat treating furnace rolls was to be properly controlled.

Adhesive wear occurs at any temperature, and atomic inter-diffusion and re-crystallization may be absent. Nonetheless, the conditions at the interface during adhesive wear are identical to those prevailing in the "cold welding" process. It is preferable to use the term "adhesive wear" rather than "welding wear".

FIG. 6, shows the schematic form of the junction of two contacting materials being sheared. If the shear strength of the junction is much bigger than the bulk strength of the top material, shear will take place along path 2 producing fragment shaded. If the force required to break through the interface of the two materials in contact, either because of the strength of the adhesion forces or because of the compound alloy formed at the interface (see FIG. 7) is larger than the force required to break through a continuous surface inside one of the two materials, the break will occur along the latter surface producing a transferred wear particle.

Greenwood and Tabor (1957) and Bikerman (1962) demonstrated that it will be a very rare event when a junction breaks precisely along its original interface since micro-solubility (micro-welding) will always occur between metallic materials.

FIG. 7(*a*) shows a typical metallurgical weld; FIG. 7(*b*) shows a typical adhesional joint.

The previous discussion suggests that the breaks that do not take place at the interface, will occur inside the softer material (the steel strip being carried), which by definition has a lower mechanical strength than the harder material of the roll wear rings. This is not always the case, although usually more fragments of the softer material (the strip) attach to the roll (build up) than the other way around.

I have found that in the majority of cases where buildup has occurred on the rolls, pitting was also present. This suggests that either the harder materials have local regions of low strength, or that the compound formed between the two materials in contact were stronger than the roll material. This tends to indicate that no matter how hard we make the roll material, we will not be able to reduce its wear to zero. But, by modifying the type of wear ring material in contact with the strip to render a very high hardness with a concentrated amount of "pseudo metals" like metallic carbides that minimize or eliminate solubility into the steel strip being conveyed, we can reduce and nearly eliminate the annealing and heat treating furnace rolls' failure from adhesive wear (pitting or build-up).

While the roll body material can be any high strength metallic alloy material (high nickel/chrome alloy), the wear rings must have high hardness, high carbide content (undesirable in the roll body material because of low impact resistance) and the minimum nickel possible commensurate with the σy requirement and as high a carbon content as possible (eutectic or near eutectic) to aid in the carbide formation and to impart the highest possible surface hardness. I have also found that centrifugal casting these alloys enhances the concentration and densification of the carbide grains on the contact surfaces, thus further improving their anti-adhesion behavior and performance.

The wear rings' material chemical composition limits are as follows:

| % | % | |
|---|---|---|
| 10.0 | <$N_i$ | <30.0 |
| 20.0 | <$C_R$ | <40.0 |
| 0.4 | <C | <1.8 |
| 2.0 | <W | <10.0 |
| 0.5 | <$M_O$ | <1.5 |
| 4.0 | <$C_O$ | <30.0 |
| 0.8 | <$S_i$ | <2.5 |
| 1.0 | <Mn | <2.0 |
| 0.0 | <V | <10.0 |

Note that all the materials listed or their carbides in the formulation have extremely low values of coefficient of adhesion in compression (Reference Sykorski, 1963). The exact formulation depends on the application's maximum temperature and the chemical composition of the strip being processed. For example, the chemical composition for the optimum wear ring material when processing low carbon steel strip at operating temperatures up to 2200° F., assuming proper area of contact selection, will be as follows:

| | | % | | |
|---|---|---|---|---|
| $N_i$ | → | 30.0 | ± | 1.5 |
| $C_R$ | → | 28.0 | ± | 2.0 |
| C | → | 0.8 | ± | 0.1 |
| W | → | 6.0 | ± | 1.0 |
| $M_O$ | → | 0.6 | ± | 0.1 |
| $C_O$ | → | 10.0 | ± | 2.0 |
| $S_i$ | → | 1.5 | ± | 0.2 |
| $M_n$ | → | 1.5 | ± | 0.2 |
| V | → | Trace | | |

If the maximum operating temperature were to be reduced from 2200° F. to 1800° F. (typical in a heat treating furnace) with its corresponding strip compression hardness increase and adhesion energy decrease, the amount of cobalt in the formula could be reduced and the iron or nickel increased to obtain a less expensive material that would serve as well, due to the less severe requirement. The chemical formulation of the material will take the form shown in my co-pending application.

To summarize:

A. The cause of failure (of annealing and heat treating furnace rolls) is: ADHESION.

B. The failure effect is: "pick-up" (roll surface build-up) and "pitting" (wear).

C. The consequences of these effects are:

1. Poor strip quality.
2. Low roll life, and
3. High maintenance cost.

In my co-pending application, I discussed the standard belief that adhesion is a linear phenomenon. In other words, if under a constant load (P) the area of contact is increased (the load per unit area decreased), the adhesion forces will linearly decrease. Through testing, both in the laboratory and in actual furnace practice, I have found this concept to be incorrect.

The adhesion forces decrease with a decrease of load per unit area up to a point (which I call "optimum contact area point"), below which the adhesion forces begin to increase again. In other words, adhesion is not a linear phenomenon, but a quadratic or cubic function of the following variables:

A. Load
B. Area of Contact
C. Temperature
D. Roll velocity
E. Composition of the materials in contact My invention addresses the cause of the failure and, by doing so, eliminates high maintenance costs in annealing and heat treating furnace rolls, namely minimizing or eliminating adhesion by:

A. Optimizing the area of contact between the strip and the rolls by reducing it to the optimum area required, based on the non-linear behavior of the adhesion phenomenon.

B. Optimizing the roll materials through the formulation of:

1. Wear resistant metallic alloys, rich in hard covalent bonded particles ($C_{RX}$, $C_X$, WC, $V_XC_X$, etc.), dispersed in a cobalt-nickel-based solid solution matrix. (Reference: A. F. Underwood "Aspects of Rubbing Surfaces", Summer Conference on Friction and Surface Finish, M.I.T., Cambridge, Mass. 1940 pp. 5 to 12.)
2. By mechanical modification of the ring surface contact area, taking advantage of the centrifugal casting process that condenses and concentrates the high covalent bonded alloy particles (chromium carbide, tungsten carbide and the like) on the wear-ring/strip outer layer contact zone.
3. Utilization of near eutectic or hyper-eutectic alloys.

Water cooling is sometimes used to reduce adhesion, since adhesion is lower at lower temperatures. The effects (price paid) introduced when water cooling is used are:

A. The strip being rolled presents "chill lines", which are very difficult to roll.

B. The rolls (being cooled in every revolution) touching the hot strip develop thermal shock ("fire cracks") failure.

C. Last, but not least, an enormous energy waste (as much as 60%) is created, since water cooling the rolls removes heat from the furnace and strip.

Nonetheless, water cooling does reduce adhesion. And, in spite of the chill lines, it produces a better quality strip surface.

Still further objects and advantages of the invention will become readily apparent to those skilled in the art to which the invention pertains, upon reference to the following description.

DESCRIPTION OF THE DRAWINGS

The description refers to the accompanying drawings in which like reference characters refer to like pads throughout the several views, and in which.

DESCRIPTION OF THE PREFERRED EMBODIMENT

Figure 1:
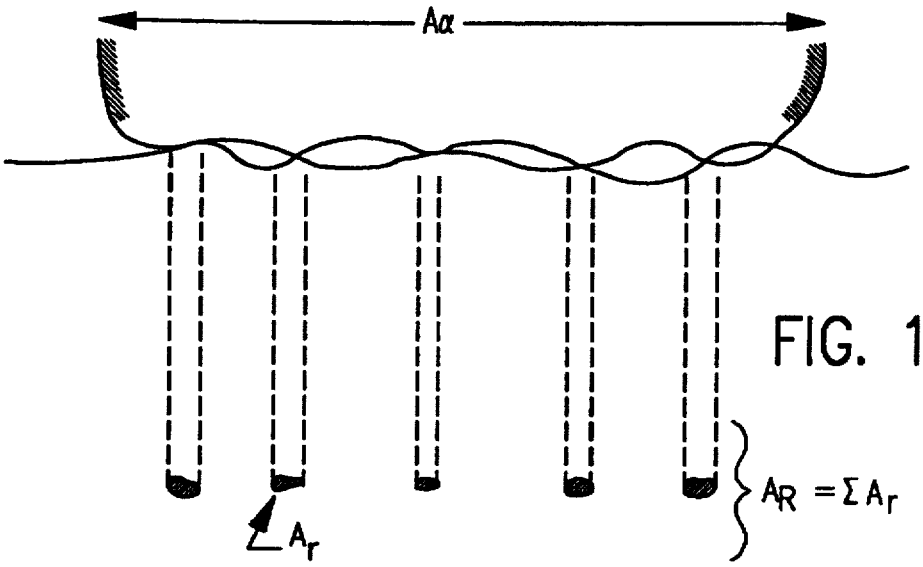
FIGS. 1–7(*b*) illustrate the theory of my invention.
Figure 2:
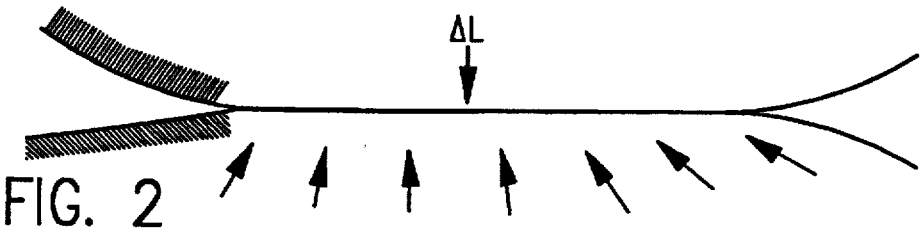
Figure 3:
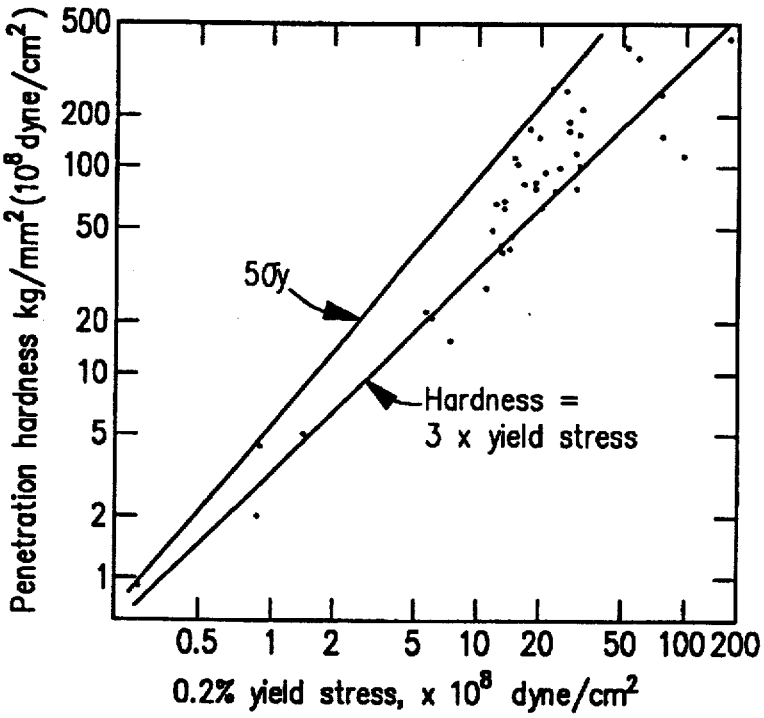
Figure 4:
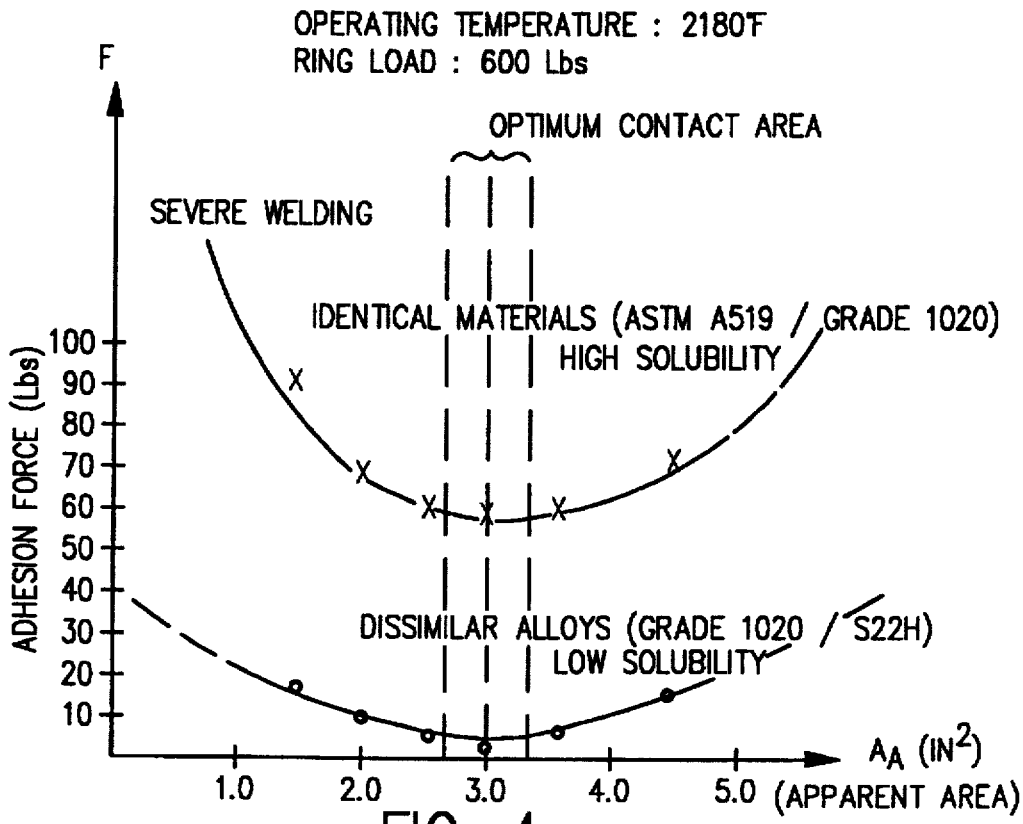
Figure 5:
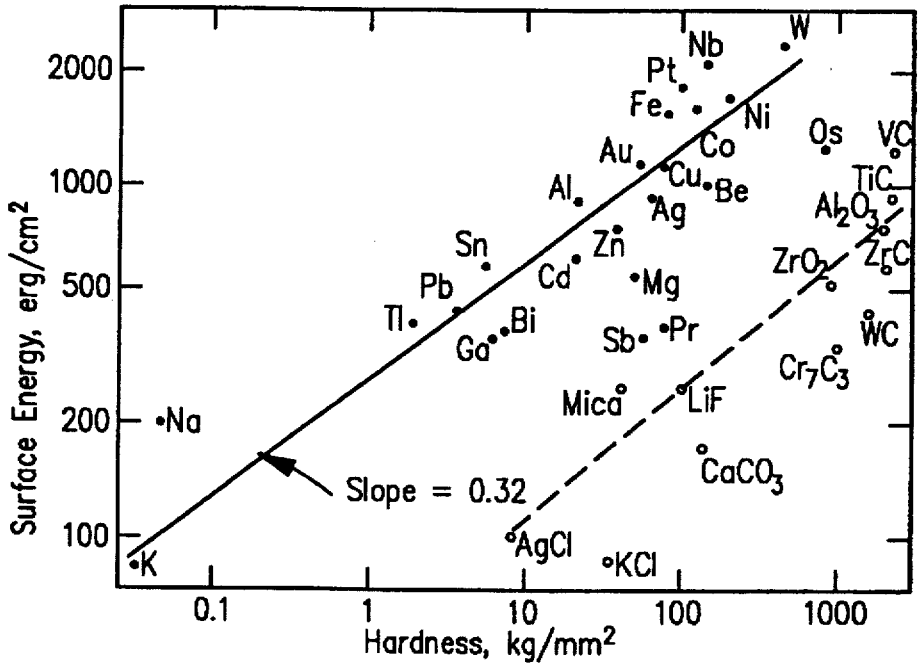
Figure 6:
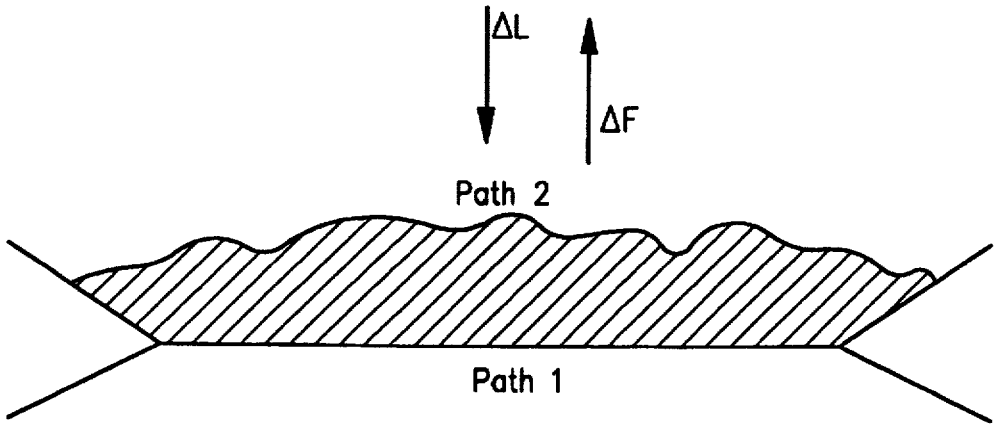
Figure 7:
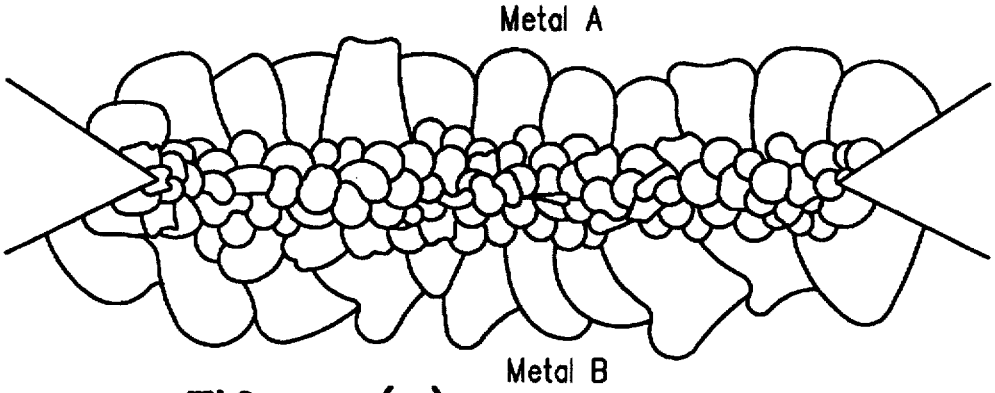
Figure 7:
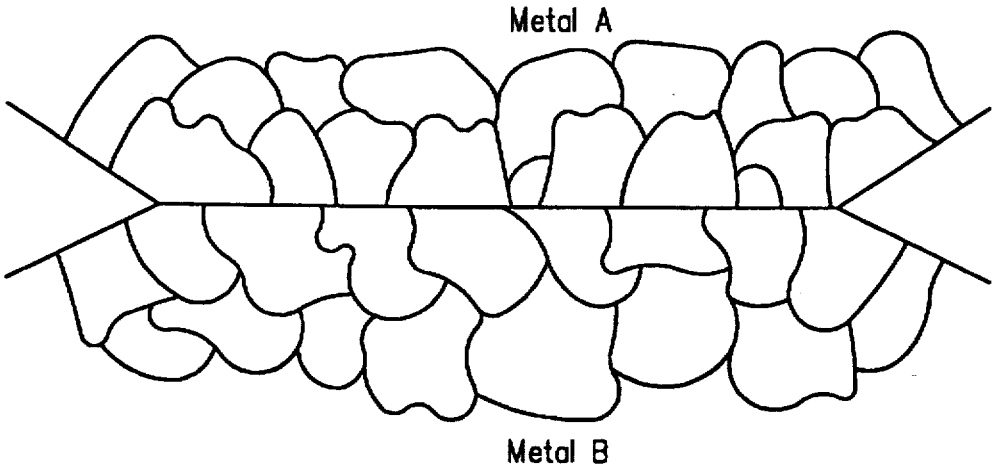
Figure 8:
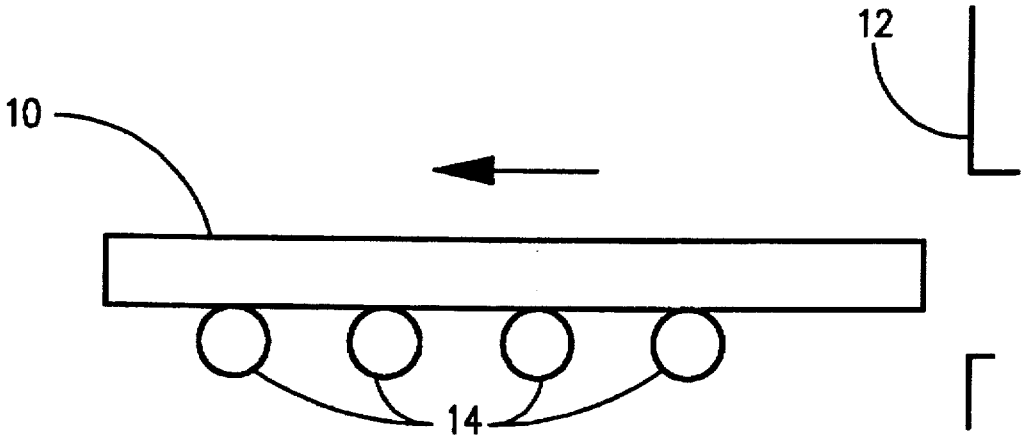
FIG. 8 is a view of a steel strip exiting an annealing furnace on rolls, illustrating the preferred embodiment of the invention.
Figure 9:
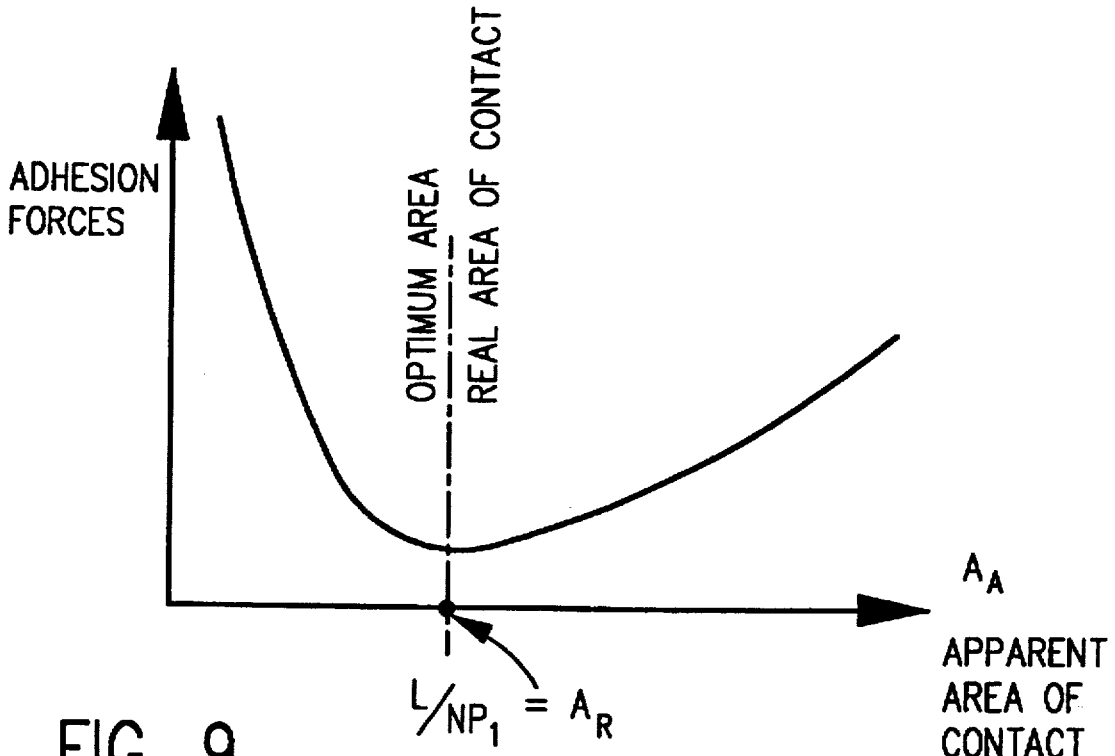
FIG. 9 is a chart indicating the relationship between the adhesion forces on a roll and the area of contact.

Referring to the drawings, FIG. 9 schematically illustrates a steel strip 10 being removed from an annealing furnace 12 on a series of driven conveyor rolls 14. The general purpose is well known to those skilled in the art.

Figure 10:
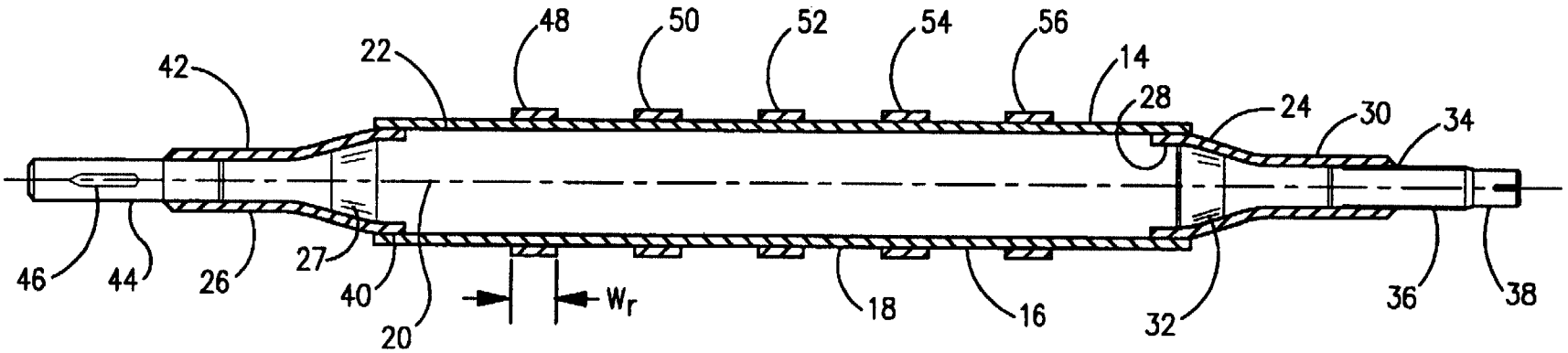
FIG. 10 is a longitudinal cross-section through a roll, illustrating the preferred embodiment of the invention.

FIG. 10 illustrates the longitudinal cross-section of a typical roll 14. Roll 14 has a tubular body 16, preferably NICHRON 72, which is selected for its strength at the highest operating temperature. The reason is that a strip has substantial weight in addition to substantial width. The overall length of the roll varies with the width of the strip being carried to about 120" to 140". The body has cylindrical outside surface 18 with a diameter and thickness depending on the weight of the strip (about 10½" as an example). Body 16 is formed about a longitudinal axis 20, and has a ⅜" vent hole 22 adjacent one end. The body has a internal diameter of 8¼" in the particular example being presented.

A pair of bell-shaped members 24 and 26 are welded to opposite ends of body 16. Each bell-shaped member has an inner end 28 welded to the end of the body for a distance of about 3". Members 24 and 26 each have a length of about 16¼", including a narrowed cylindrical section 30 about 10¾" long. A ceramic plug 32 is received in the tapered midsection of member 24. Member 24 is preferably formed of NICHRON 72 available from Alphatech, Inc., 34210 James J. Pompo Drive, Fraser, Mich. 48026. The ceramic plug of Alphatech ZRS10 is available from the same source.

The outer end of section 30 receives the end of a shaft 34. The shaft is welded to tubular section 30. About 3½" of the shaft is received inside Section 30. The shaft has a midsection 36 about 6½" long for seating on a bearing, and a keyed journalled end 38.

Bell-shaped section 26 has a 3" long cylindrical end received at the opposite end of tubular body 16. Section 26 is also welded to the tubular body. A second ceramic plug 27 is received in the funnel-shaped midsection of body 26. Body 26 has a cylindrical outer end 42 having a 3½" internal diameter adapted to be seated in a bearing. The outer end 42 receives the inner end of a shaft 44 which is aligned with the longitudinal axis 20 of the roll as well as the axis of shaft 36. Shaft 44 has about a 7" keyway 46. For this particular example, five wear rings 48 are mounted on the tubular body. Each wear ring has a 12" outside diameter and a width "W," of 3¼". The rings are spaced a distance of 10" between adjacent rings with the center of ring 52 being located 35" from the end of tubular body 16. The wear rings, whose material has been selected, in this example, for its low "pick-up" characteristic when in contact with low carbon steels, are slid onto the tubular body and welded in position. The ring material, again in this example, is preferably a NICO 6-1 alloy steel, or in the alternative, NICO 10 alloy steel, both available from Alphatech, Inc. The shaft ends 44 and 36 are preferably a 304 alloy steel or in the alternative, a 17-4 alloy steel.

The ring material is selected by a comparison with the material of a steel strip so that the two materials now meet all or most of the six requirements outlined earlier. In addition, the ring material is selected for its durability and its appropriate oxidation characteristics.

The rings can be easily removed and replaced, at a fraction of the cost of a new conventional roll. Further, the rings minimize the heat radiated and transferred from the steel strip to the remainder of the roll, thus enhancing the life of the welds connecting the bell-shaped shaft members to the tubular body.

The chemical composition of the wear rings is closely controlled. The most important elements to control are as follows:

| | | % | | |
|---|---|---|---|---|
| $N_i$ | → | 20.0 | ± | 10.00 |
| $C_R$ | → | 30.0 | ± | 10.00 |
| C | → | 1.0 | ± | 0.80 |
| W | → | 6.0 | ± | 4.00 |
| $M_O$ | → | 1.0 | ± | 0.50 |
| $C_O$ | → | 18.0 | ± | 12.0 |
| $S_i$ | → | 1.5 | ± | 0.2 |
| $M_O$ | → | 1.5 | ± | 1.0 |
| V | → | 5.0 | ± | 5.0 |

Experimental testing that I have conducted has shown that these elements are related by the following empirical equation:

$$\frac{Si + [C(Ni + Co)/40)]^3}{.20W + .10(Cr + Ni + CO - 68)} = 1.0 \pm .12$$

when the material of the strip in contact with the wear rings is low carbon steel.

The width of the ring is carefully chosen, recognizing the relationship and difference between the apparent area of contact and the real area of contact between the strip and the wear ring (see FIG. 9) and its impact on the adhesion or "pick-up" characteristics between the roll and the strip. For example, referring to FIG. 9, the optimal theoretical ring area is determined by the formula:

$$A_r = \frac{L}{NP}$$

Where:

t=Total Load

N=Number of Rings

P=Penetration Hardness

The total friction force:

$$F = T_{AU} \times A_R$$

shows the importance of minimizing the contact area $A_R$.

Where:

$T_{AU}$=Average Shear

Coefficient of Friction:

$$f = \frac{F}{L} = \frac{T_{AU} \times A_C}{P \times A_r} = \frac{T_{AU}}{P}$$

is independent of the area in contact and shows the importance of the selection of the materials in contact, but the total friction force is not.

Figure 11:
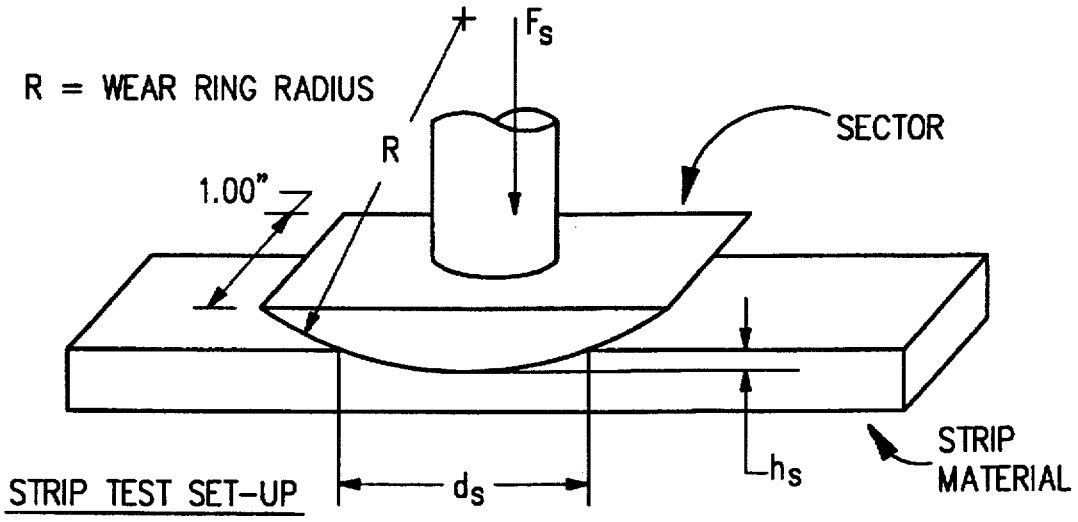
FIG. 11 is a view of the strip test set-up.

In order to arrive at the optimum width of the wear rings, an experimental test must be performed utilizing a sample of the strip material to be conveyed and a metal sector with a radius identical to the radius selected for the wear rings (see FIG. 11). A compression test can be conducted with the strip material preheated to the furnace operating temperature and the value of the penetration ($h_s$) (see FIGS. 11 and 12) versus the compression force ($F_s$) recorded. If the width of the metal sector of radius "R" has a unit thickness, the values of the contact area can be easily calculated because of the geometrical relationship. The area of contact $A_s$ on the curve section of the sector due to the extremely small penetration ($h_s$) will be sufficiently close to the area calculated using the cord ($d_s$). In other words, $$A_s = d_s(in)^2$$

Figure 12:
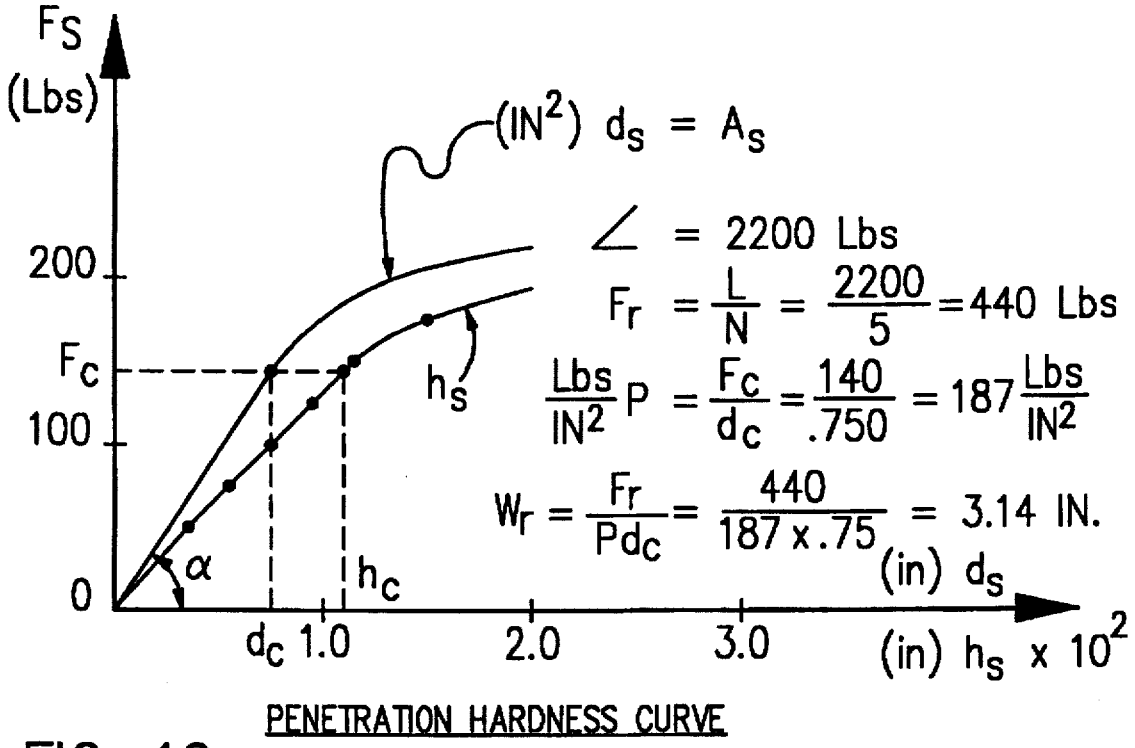
FIG. 12 is a penetration hardness curve.

From FIG. 12, it can be established that the point at which the deformations ($h_s$) (or $d_s$) are no longer proportional to the force ($F_s$) applied occurs approximately at a value of $F_s=F_c$. A line forming an angle α with respect to the $d_s$ axis will intercept the $F_s$-versus-$d_s$ curve plotted at that point where:

$$\frac{F_c}{d_c} = P$$

or

TANGENT α=P (P.S.I.)

Where:

$F_c$=Critical sector load $d_c$=Critical length of contact

P=Penetration hardness

Theoretically, at a given strip temperature this value ($d_c$) is unique for each strip material being processed and for each particular value of the wear ring radius (R). Testing has demonstrated, however, that the values of ($d_c$) are nearly identical for most carbon steel materials operating at the same temperature, thus simplifying the calculation of the optimum wear ring area in most cases.

After the number of wear rings to be used on the roll has been selected, based on the width of the strip to be conveyed (usually three to six rings will be sufficient), the total load force applied by the strip on the individual rings can be established as follows:

$$F_r = \frac{L}{N}$$

Where:

L=Total Load

N=Number of rings

The width of the wear rings can then be calculated as follows:

$$W_r = \frac{F_r}{P \times d_C}$$

And, since $F_c$ was established for a unit width, then also $$W_r = \frac{F_r}{F_c}$$

The importance of obtaining the value of $d_c$ by experimental testing is that it includes the surface properties of the material being conveyed. The material surface properties are important since an energy change takes place during the motion. This is a result of the volume deformation of the strip in contact with the wear ring, brought about by its own weight. When the surface energy is taken into consideration, $A_r$ (real area of contact) will always be greater than is indicated in:

$$A_r = \frac{L}{NP}$$

This effect is especially pronounced when the surface energy is very large or the surface roughness is very small.

Thus, may it be understood that I have described an annealing roll having replaceable wear rings. The wear rings are chosen of a material having a low welding characteristic with respect to the steel strip being carried. In addition, the wear rings shape is designed to optimize wear characteristics according to the load being carried.

Having described my invention, I claim:

1. A roll for transporting a heated, metal strip material comprising:

an elongated roll body; and a plurality of generally circumferential wear rings encircling said roll body, wherein each of said wear rings has a radius extending greater than the radial dimension of said roll, said wear rings having an outer surface adapted for contacting and supporting said metal strip material during transport thereof, and wherein said outer surface is composed of a metal or metal alloy whose constituent metals have low coefficients of adhesion in compression with respect to said strip material being transported and supported by said rolls.

2. A roll according to claim 1, wherein said wear ring outer surface is composed of an alloy containing at least one metal selected from the group consisting of chromium carbide, tungsten carbide, and vanadium carbide.

3. A roll according to claim 1, wherein said outer surface of said wear ring has a high carbon content.

4. A roll according to claim 1, wherein said outer surface of said wear ring is composed of an alloy containing the following constituents in the indicated ranges:

| % | | % |
|---|---|---|
| 10.0< | Ni | <30.0 |
| 20.0< | Cr | <40.0 |
| 0.4< | C | <1.8 |
| 2.0< | W | <10.0 |
| 0.5< | Mo | <1.5 |
| 4.0< | Co | <30.0 |
| 0.8< | Si | <2.5 |
| 1.0< | Mn | <2.0 |
| 0.0< | V | <10.0 |

5. A roll according to claim 1, wherein the width of said wear rings is determined by establishing an optimum real area of contact, $A_r$, between said wear rings and said strip material and according to the formula $A_r$=L/NP, wherein $A_r$ is the optimum real area of contact;

L is the load of said strip material on said wear rings;

N is the number of rings; and

P is the penetration hardness of the strip material at the operating temperature range of said strip material during the time period when it is in contact with said wear ring outer surface, so as to reduce adhesion forces between said wear ring surface and said metal strip material to a required minimum value.

6. A roll according to claim 1, wherein said wear ring is integrally attached to said roll body.

7. A roll according to claim 1, wherein said wear ring is replaceably attached to said roll body.

8. A roll for transferring a flat, heated strip of a first steel alloy from an annealing furnace, comprising:

an elongated tubular body having a longitudinal axis;

shaft means attached to opposite ends of the body for supporting the body for rotation about the axis; and structure integrally disposed on said body forming a discontinuous surface for contacting and supporting the flat heated strip on the tubular body as the tubular body is being rotated, said structure being formed of a second steel alloy that is relatively insoluble with respect to the first steel alloy of the heated strip, said structure having a material chemical composition limits of:

| % | % | |
|---|---|---|
| 10.0 | <$N_i$ | <30.0 |
| 20.0 | <$C_R$ | <40.0 |
| 0.4 | <C | <1.8 |
| 2.0 | <W | <10.0 |
| 0.5 | <$M_O$ | <1.5 |
| 4.0 | <$C_O$ | <30.0 |
| 0.8 | <$S_i$ | <2.5 |
| 1.0 | <Mn | <2.0 |
| 0.0 | <V | <10.0 |

9. A roll as defined in claim 8, in which the structure comprises longitudinally spaced rings attached to the cylindrical surface of the body.

10. A roll as defined in claim 9, in which the width and diameter of the ring is chosen to minimize the adhesion forces between each ring and the steel strip.

11. A roll as defined in claim 10, in which the area of contact between the steel strip and the roll is chosen according to the formula L/P, in which the L is the load of the strip on the ring and P is the penetration hardness of the strip material at the furnace operating temperature.

12. A roll as defined in claim 11, in which the area of contact between the steel strip and the roller is chosen according to the formula L/σy in which the L is the load of the strip on the ring, and σy is the material strength of the strip material in compression.

13. A roll as defined in claim 9, in which a ring is replaceably welded to the body.

14. A roll as defined in claim 8, in which the area of contact between the steel strip and the structure on the roll is chosen according to the formula L/P, in which L is the load of the strip on the ring and P is the penetration hardness of the strip material at the furnace operating temperature.

15. A roll for transferring a flat heated strip of a first steel alloy from an annealing furnace, comprising:

an elongated tubular body having a longitudinal axis;

shaft means attached to opposite ends of the body for supposing the body for rotation about said axis;

integral structure of a second steel alloy forming longitudinally spaced enlargements on the tubular body for contacting and supporting the flat steel strip as the tubular body is being rotated;

the enlargements having a surface area contacting the steel strip, the surface area being capable of minimizing either removal of the second steel alloy from said integral structure by the heated strip, or removal of the first steel alloy from the heated strip by the integral body structure.

16. A roll as defined in claim 15, in which the surface area of the enlargements contacting the steel strip is chosen according to the formula L/P, in which L is the load of the strip on the enlargements, and P is the penetration hardness of the strip material at the furnace operating temperature.

17. A roll as defined in claim 15, in which the enlargements are attached to the tubular body adjacent the areas of contact of the enlargements with the heated strip.

18. A roll as defined in claim 8, in which the structure is replaceably welded to the tubular body.

19. A roll for transferring a flat, heated strip of a steel alloy from an annealing furnace, comprising:

an elongated tubular body having a longitudinal axis, and adapted to be supported with said axis in a horizontal position;

shaft means attached to opposite ends of the body for supporting the body for rotation about said axis;

a plurality of annular members disposed in longitudinally spaced positions along the tubular body and about the longitudinal axis thereof, each annular member having an annular surface for contacting and supporting the heated strip for horizontal motion; and each of said annular members being integrally attached to the body to prevent motion of the annular member with respect to the tubular body.

20. A roll for transferring a heated strip of a first steel alloy, comprising:

an elongated tubular body having a longitudinal axis;

shaft means attached to opposite ends of the body for supporting the body for rotation about the axis; and structure integrally disposed on said body for contacting and supporting the heated strip on the tubular body as the tubular body is being rotated, said structure being formed of a second steel alloy that is relatively insoluble with respect to the first steel alloy of the heated strip, said structure having a material chemical composition limits of:

| % | % | |
|---|---|---|
| 10.0 | <$N_i$ | <30.0 |
| 20.0 | <$C_R$ | <40.0 |
| 0.4 | <C | <1.8 |
| 2.0 | <W | <10.0 |
| 0.5 | <$M_O$ | <1.5 |
| 4.0 | <$C_O$ | <30.0 |
| 0.8 | <$S_i$ | <2.5 |
| 1.0 | <Mn | <2.0 |
| 0.0 | <V | <10.0 |

* * * * *